United States Patent [19]

Uchida

[11] Patent Number: 4,694,169

[45] Date of Patent: Sep. 15, 1987

[54] MASS SPECTROMETER

[75] Inventor: Minoru Uchida, Katsuta, Japan

[73] Assignee: Hitachi, Ltd., Tokyo, Japan

[21] Appl. No.: 783,530

[22] Filed: Oct. 3, 1985

[30] Foreign Application Priority Data

Oct. 5, 1984 [JP] Japan ..... 59-208236

[51] Int. Cl.[4] ..... H01J 49/30; H01J 49/32

[52] U.S. Cl. ..... 250/296; 250/298; 250/292; 250/396 R; 250/281

[58] Field of Search ..... 250/281, 282, 290, 292, 250/294, 296, 299, 396, 298

[56] References Cited

U.S. PATENT DOCUMENTS 4,107,527 8/1978 Cherepin et al. ..... 250/292

OTHER PUBLICATIONS

Vogt et al., Journal of Physics E: Scientific Instruments, vol. 9, 1976, pp. 38–40.

Blauth, Dynamic Mass Spectrometers, 1966, pp. 140–141.

*Primary Examiner*—Craig E. Church

*Assistant Examiner*—Jack I. Berman

*Attorney, Agent, or Firm*—Antonelli, Terry & Wands

[57] ABSTRACT

When AC voltages in-phase to each other are superposed on the DC voltages applied to a pair of opposing electrodes of a quadrupole lens, the waveform of the intensity of the ion beam is disturbed only if the central orbit of ions is deviated from the center of the quadrupole lens. In view of this, adjustment of the central orbit of ions is facilitated with the help of variations in the waveform of the intensity of the ion beam while superposing the AC voltages in-phase to each other on the DC voltages applied thereto.

9 Claims, 4 Drawing Figures

MASS SPECTROMETER

BACKGROUND OF THE INVENTION

This invention relates to a mass spectrometer, in particular to a mass spectrometer, in which the central orbit of ions can be easily adjusted so that ions to be measured having a predetermined mass number pass through the center of the exit of the device.

Heretofore, for a quadrupole lens in this sort of device, a method is employed by which only DC voltages are applied to each of the pairs of opposing electrodes. This method is very useful for transmitting ions with a high efficiency. Although it is desirable that ions to be measured having a predetermined mass number pass through the center of the exit of the device, in this sort of device it was impossible to judge whether the central orbit of ions pass through the center of the quadrupole lens. This sort of device is described e.g. in the article entitled "High-resolution High-sensitivity Mass Spectrometers" by H. Matsuda in Mass Spectrometry Reviews, Volume 2, No. 2, 1983.

SUMMARY OF THE INVENTION

The object of this invention is to remove the drawback described above of the prior art techniques and to provide a mass spectrometer, in which the central orbit of ions can be easily adjusted so that ions having a predetermined mass number pass through a detector located at a predetermined position. That is, the object of this invention consists in that adjustment of the central orbit of ions is facilitated by observing the position of the orbit of ions with the help of variations in waveform of the intensity of an ion beam, while superposing AC voltages in-phase with each other on the DC voltages applied to a pair of opposing electrodes of the quadrupole lens.

This invention has been made on the basis of the knowledge of the inventors that the waveform of the intensity of the ion beam is disturbed, only if the central orbit of ions is deviated from the center of the quadrupole lens, when AC voltages in-phase with each other are superposed on the DC voltages applied to a pair of opposing electrodes and it facilitates adjustment of the central orbit of ions with the help of variations in the waveform of the intensity of the ion beam, while superposing the AC voltages, which are in-phase with each other, on the DC voltages applied thereto.

DESCRIPTION OF THE PREFERRED EMBODIMENT

Figure 1:
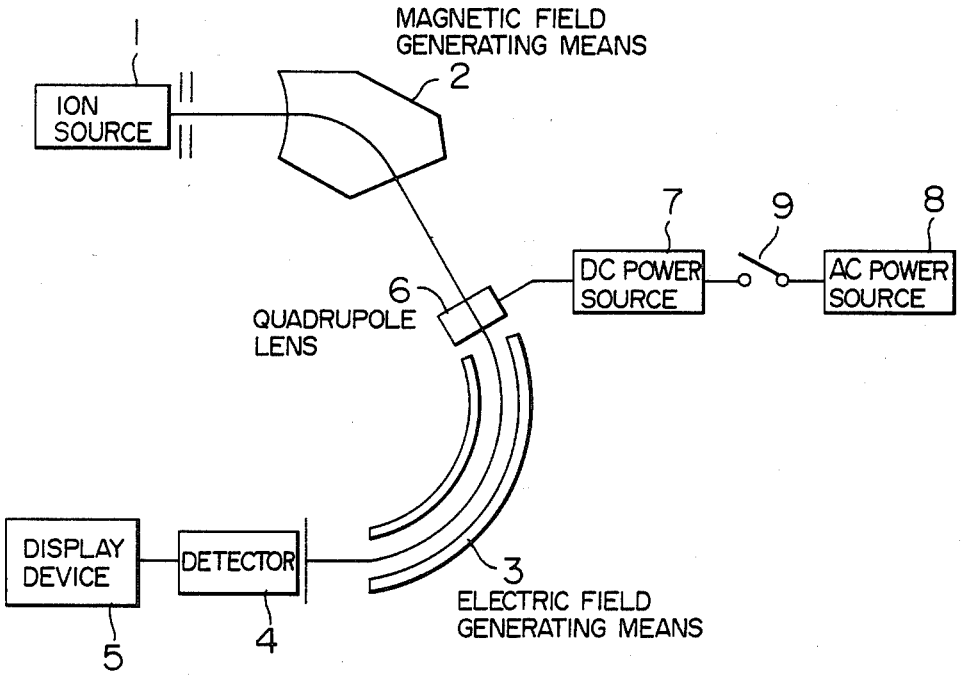
FIG. 1 is a block diagram of a mass spectrometer, which is an embodiment of this invention.
Figure 2:
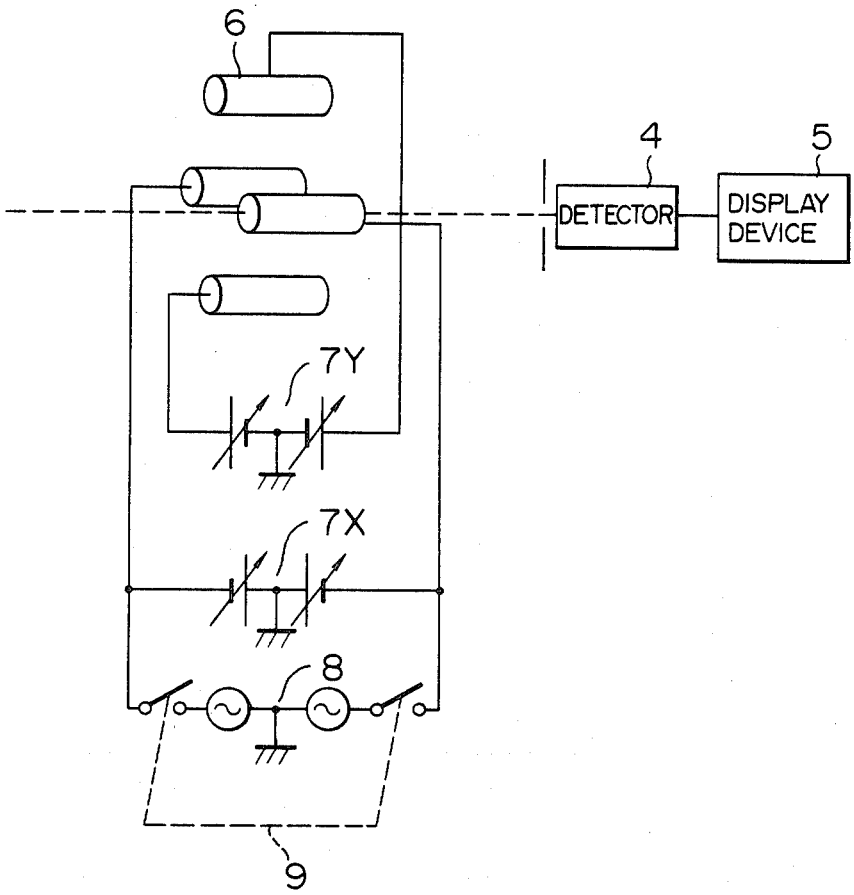
FIG. 2 is a circuit diagram representing an embodiment of the characterizing part of this invention.

Hereinbelow, a mass spectrometer, which is an embodiment of this invention, will be explained. In FIG. 1, the reference numeral 1 represents an ion source; 2 a magnetic field generating means; 3 a coaxial cylinder type electric field generating means; 4 a detector; 5 a display device; 6 a quadrupole lens; 7 a DC power source; 8 an AC power source; and 9 a switch. Further, FIG. 2 is a scheme representing the quadrupole lens 6, the DC power source 7, the AC power source 8 and a switch 9 in detail, which are indicated in FIG. 1. In FIG. 2, 7Y represents the DC power source for the Y direction (the direction perpendicular to the sheet in FIG. 1); 7X the DC power source for the X direction (the direction parallel to the sheet in FIG. 1); 8 the AC power source; 9 the switch; 4 the detector; and 5 the display device. The electric field generating means, the magnetic field generating means and the ion source are omitted in FIG. 2.

Figure 3A:
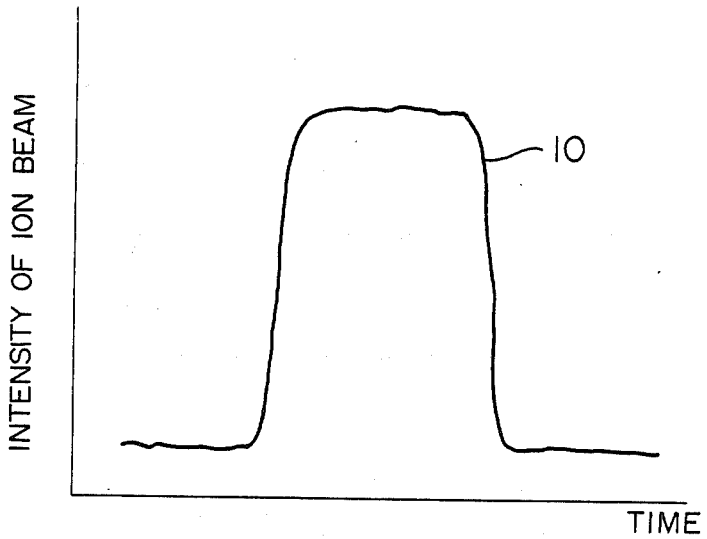
FIG. 3A is a scheme illustrating the relation between time and waveform of the intensity of the ion beam, when DC voltages are applied to a pair of opposing electrodes of a quadrupole lens.

In FIG. 1, ions emitted by the ion source 1 are deflected by the magnetic field generating means 2 and the electric field generating means 3 and after passing through the detector 4 they are displayed on the display device 5. In this case, when the magnetic flux density of the magnetic field generated by the magnetic field generating means 2 is kept constant and the intensity of the electric field generated by the electric field generating means 3 as well as the ion acceleration voltage are varied, a waveform representing variations in intensity of the ion beam as indicated in FIG. 3A is obtained. Then, the case where the switch 9 is closed and the AC power source 8 is connected with the DC power source 7 will be explained below, referring to FIG. 2.

Figure 3B:
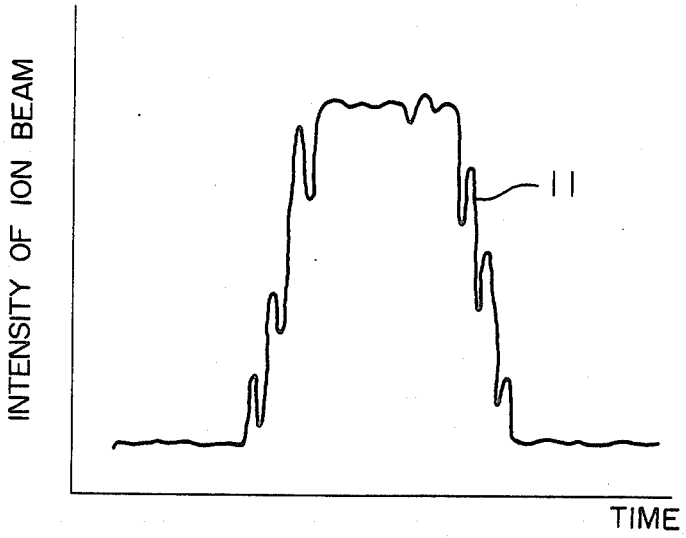
FIG. 3B is a scheme illustrating the relation between time and waveform of the intensity of the ion beam, when the DC voltages and AC voltages are superposed on each other and applied to the pair of opposing electrodes of the quadrupole lens.

In FIG. 2, AC power sources 8 are in-phase; their voltage is 10 mV and their frequency is 50 Hz. At this time, when the switch 9 is closed, the output voltages of the AC power sources 8 are superposed on the voltage of the DC power source 7X for the X direction. If the central orbit of the ions passes through the center of the quadrupole lens, the effects of the AC voltages on the ion beam compensate each other owing to the effect of the opposing electrodes of the quadrupole lens 6. Therefore, ions are detected by the detector 4 without being influenced by the AC voltages and are displayed on the display device 5. The waveform of the intensity of the ion beam is as indicated by 10 in FIG. 3A. However, when the central orbit of ions is not on the center of the quadrupole lens 6, ions are influenced by the AC voltages, detected by the detector 4 and displayed on the display device 5. In this case, the waveform of the intensity of the ion beam is as indicated by 11 in FIG. 3B. When it is compared with the waveform 10, it is seen that it has superposed thereon, so as to be distorted by, the AC components. When the DC power source 7X for the X direction is adjusted so that this distortion (ripple) of the waveform 11 disappears, ions can pass through the center of the quadrupole lens 6. Consequently, when the output voltages of the AC power sources 8 are superposed thereon, it is possible to adjust easily the central orbit of ions, while observing the display device.

Furthermore, in this embodiment, for the plurality of the opposing electrodes of the quadrupole lens, supposing that ions are charged positively, the polarity of the opposing electrodes for the Y direction (the direction perpendicular to the sheet of FIG. 1) is selected to be positive and that of the other pair of opposing electrodes for the X direction (the direction parallel to the sheet of FIG. 1) is selected to be negative. On the other hand, in the case where ions to be measured are charged negatively, the polarity of the opposing electrodes for the Y direction should be negative and that of the opposing electrodes for the X direction should be positive. Further, in order to make the whole device more compact and to ameliorate the measurement accuracy, the ion beam should be compressed in the direction perpendicular to the sheet of FIG. 1 and expanded in the direction parallel thereto. On the other hand, the ion beam is deflected in the direction perpendicular to the direction of advancement of the ion beam and parallel to the sheet of FIG. 1. Therefore, the AC voltages superposed on the DC voltage for opposing electrodes of the quadrupole lens 6 are applied only to the opposing electrodes for the X direction.

In addition, although the switch 9 described in the embodiment of this invention is not indispensable, it is necessary, when it is desired to observe the waveform of the intensity of the ion beam, in the case where the AC voltages are not applied to one of the pairs of opposing electrodes of the quadrupole lens.

According to this invention, since deviation of the central orbit of ions from the center of the quadrupole lens can be observed in the form of disturbance in waveform of the intensity of the ion beam on a display device, it is possible to obtain the effect that the central orbit of ions is adjusted easily.

What is claimed is:

1. A mass spectrometer including in order along a beam path, ion source means for providing an ion beam along said beam path, magnetic field mass analyzing means, a quadrupole lens, and ion detecting means, said quadrupole lens having two pairs of electrodes, and further comprising:

means for applying variable DC voltages to each electrode of said two pairs of opposing electrodes of said quadrupole lens; and means for superposing in-phase AC voltages on said DC voltage applied to only one of said two pairs of opposing electrodes of said quadrupole lens so that an output of said detecting means indicates the degree to which the ion beam is centered on the beam path as it passes through said quadrupole lens.

2. A mass spectrometer according to claim 1, further comprising electric field mass analyzing means.

3. A mass spectrometer according to claim 1, wherein negative polarity DC voltages are applied to said one pair of opposing electrodes and positive polarity DC voltages are applied to the other pair of opposing electrodes.

4. A mass spectrometer according to claim 1, wherein positive polarity DC voltages are applied to said one pair of opposing electrodes and negative polarity DC voltages are applied to the other pair of opposing electrodes.

5. A mass spectrometer according to claim 1, wherein said means for superposing said AC voltages on said DC voltages includes an AC voltage source and switching means for selectively connecting said AC voltage source to said variable DC voltage applying means.

6. A mass spectrometer according to claim 2, wherein negative polarity DC voltages are applied to said one pair of opposing electrodes and positive polarity DC voltages are applied to the other pair of opposing electrodes.

7. A mass spectrometer according to claim 2, wherein positive polarity DC voltages are applied to said one pair of opposing electrodes and negative polarity DC voltages are applied to the other pair of opposing electrodes.

8. A mass spectrometer according to claim 2, wherein said means for superposing said AC voltages on said DC voltages includes an AC voltage source and switching means for selectively connecting said AC voltage source to said variable DC voltage applying means.

9. A mass spectrometer according to claim 6, wherein said means for superposing said AC voltages on said negative polarity DC voltages includes an AC voltage source and switching means for selectively connecting said AC voltage source to said variable DC voltage applying means.

* * * * *